US008328465B2

(12) United States Patent
Chouest

(10) Patent No.: US 8,328,465 B2
(45) Date of Patent: Dec. 11, 2012

(54) OFFSHORE PETROLEUM DISCHARGE SYSTEM

(75) Inventor: Gary J. Chouest, Galliano, LA (US)

(73) Assignee: Reel Pipe, LLC, Cut Off, LA (US)

( * ) Notice: Subject to any disclaimer, the term of this patent is extended or adjusted under 35 U.S.C. 154(b) by 293 days.

(21) Appl. No.: 12/655,045

(22) Filed: Dec. 22, 2009

(65) Prior Publication Data

US 2010/0226723 A1 Sep. 9, 2010

Related U.S. Application Data

(63) Continuation-in-part of application No. 11/411,489, filed on Apr. 25, 2006, now abandoned.

(60) Provisional application No. 60/674,976, filed on Apr. 25, 2005.

(51) Int. Cl.
*F16L 1/00* (2006.01)

(52) U.S. Cl. ..... 405/158; 405/166; 405/154.1; 441/4; 441/5; 114/256

(58) Field of Classification Search ..... 405/158, 405/166, 169, 170, 154.1; 137/899.2; 114/256, 114/257, 293; 441/3–5; 414/137.1–143.2
See application file for complete search history.

(56) References Cited

U.S. PATENT DOCUMENTS

| | | | | |
|---|---|---|---|---|
| 3,541,622 | A * | 11/1970 | Harlow | 441/5 |
| 3,644,695 | A * | 2/1972 | Shuey et al. | 219/611 |
| 4,155,669 | A * | 5/1979 | Rochelle | 405/158 |
| 4,624,645 | A * | 11/1986 | Kiely et al. | 441/4 |
| 5,035,540 | A * | 7/1991 | Hill et al. | 405/158 |
| 6,571,723 | B1 * | 6/2003 | Bech et al. | 114/230.2 |
| 7,080,673 | B2 * | 7/2006 | Pollack et al. | 141/387 |
| 2005/0016431 | A1 * | 1/2005 | Oma et al. | 114/230.1 |
| 2005/0047871 | A1 | 3/2005 | Lee et al. | |
| 2006/0210361 | A1 * | 9/2006 | Lamison | 405/168.3 |

FOREIGN PATENT DOCUMENTS

JP 07102773 4/1995

(Continued)

OTHER PUBLICATIONS

RFP N00033-04-R-3301, Request for Proposal, issued by Military Sealift Command for Dry Cargo Time Charter (Drytime), issued on Dec. 12, 2003.

(Continued)

*Primary Examiner* — Sean Andrish
(74) *Attorney, Agent, or Firm* — Hunton & Williams LLP

(57) ABSTRACT

A method and associated vessel for transferring liquids from offshore tankers to an onshore storage facility. The system utilizes a flexible pipe that is heavier than the water it displaces, such that the flexible pipe sinks to the sea floor even when empty. The high weight and relatively small profile of the flexible pipe avoids the need for anchoring the pipe to the sea floor. The flexible pipe has a bending radius of no greater than five feet, such that it can be wound onto spools onboard the vessel, and can be rapidly deployed, retrieved, and reused in another location. The vessel containing the spools of flexible pipe is dynamic positioning capable, and contains the equipment required to establish a position onshore to receive the liquid being transferred; means to deploy, retrieve, and repair the flexible pipe; and means to receive liquid from a tanker vessel and pump that liquid through the flexible pipe to the onshore storage facility.

18 Claims, 7 Drawing Sheets

FOREIGN PATENT DOCUMENTS

| | | | | |
|---|---|---|---|---|
| JP | 07102773 | A | * | 4/1995 |
| JP | 407102773 | | * | 4/1995 |
| WO | WO 2005-059432 | | | 6/2005 |

OTHER PUBLICATIONS

Response to RFP N00033-04-3301 from Edison Chouest Offshore, dated Feb. 27, 2004 (redacted).

N00033-05-C-3300, Contract for RFP N00033-04-3301, issued by Military Sealift Command to Edison Chouest Offshore, contract issued Jan. 25, 2005 (redacted).

M.D. Brightwell et al., "An Offshore Petroleum Discharge System (OPDS) Application of Commercial Technology to Military Operational Requirements," OTC 5751, pp. 47-58, 20$^{th}$ Annual Offshore Technology Conference, Houston Texas, May 2-5, 1988.

F.L. Apicella, "Offshore Petroleum Discharge System", OTC 5252, pp. 265-270, 18$^{th}$ Annual Offshore Technology Conference, Houston Texas, May 5-8, 1986.

Laura M. Seal, "MSC Accepts New OPDS Platform—Improves Ability to Support U.S. Troops Ashore," pp. 1-3, http://www.msc.navy.mil/sealift/2007/november/wheeler.htm Nov. 2007, Downloaded on Aug. 7, 2012.

Michael W. Heryford, "MV K. R. Wheeler: Commercial Solution Answers Call for Joint Requirement," pp. 17-19, The Navy Supply Corps Newsletter, http://www.navsup.navy.mil, Mar./Apr. 2008.

Contract Action Synopsis (N00033-05-C-3300), Offshore Petroleum Distribution System (OPDS) Purchase, p. 1, Apr. 18, 2012, available at https://www.fbo.gov/utils/view?id=347cb7e0c6dcd484fc9fce8dda595699.

Haiti: How to Fuel Disaster Recovery? http://blog.usni.org/2010/01/20/haiti-how-to-fuel-disaster-recovery/, Jan. 2010, Downloaded on Aug. 7, 2012.

Chapter 5, Offshore Petroleum Discharge System, Section 1, OPDS Tankers, http://www.globalsecurity.org/military/library/policy/army/fm/10-67-1/CHAP5.HTML Downloaded on Aug. 7, 2012.

* cited by examiner

OFFSHORE PETROLEUM DISCHARGE SYSTEM

CROSS-REFERENCE TO RELATED APPLICATION

This application claims priority from U.S. Provisional Application No. 60/674,976 filed Apr. 25, 2005, and is a continuation-in-part of U.S. application Ser. No. 11/411,489 filed Apr. 25, 2006, both by Gary Chouest, entitled Offshore Petroleum Discharge System, which are incorporated herein by reference for all purposes.

BACKGROUND OF THE INVENTION

1. Field of the Invention

This invention relates to the transfer of liquids from a vessel offshore, to an onshore storage facility. More particularly, the present invention concerns a method and vessel for transferring large quantities of liquids, primarily refined hydrocarbons, from large tanker vessels offshore to onshore storage tanks using flexible pipe that can be rapidly deployed and recovered. The flexible pipe is heavier than the water that it displaces, and of small enough outside diameter such that it does not require anchoring in place on the sea floor.

2. Description of the Prior Art

The ability to transfer liquids from a vessel offshore to an onshore storage facility is known in the prior art. Systems typically include the installation of pipe on the sea floor, and the anchoring of that pipe in place, often by burying the pipe, or by covering it with heavy mats. These installations are designed to prevent the pipe from moving in the current, including severe currents that may be experienced in adverse weather conditions. Accordingly, these installations are often permanent and require substantial time to install. The piping cannot be easily retrieved for use at another site. If the pipe can be retrieved at all, it is at great expense and time investment.

Systems designed for rapid deployment of pipe have utilized pipe that is lighter than the sea water which the pipe displaces, such that the empty pipe floats when placed into the water. It is only when the pipe contains a liquid that the pipe, containing the liquid, is heavy enough to sink to the sea floor. Such systems, while providing the means to rapidly deploy the pipe, also required the pipe to be anchored on the sea floor. If not anchored, the pipe was too light to be resistant enough to the currents to remain in place. Systems that utilize such a "float/sink" deployment method require significant attention to anchoring, or simply cannot be used in adverse weather conditions. Additionally, deploying the pipe initially on the sea surface subjected the pipe and the attendant vessels and personnel to added risks when confronted with significant waves, winds, and tides.

Furthermore, systems requiring that a liquid be placed in the pipe to make the pipe heavy enough to sink create a potential liquid disposal problem and increase the risk of an environmental spill. Systems using sea water in the pipe in a "float/sink" deployment, may be confronted with a substantial quantity of contaminated sea water if the pipe still contains hydrocarbon residues from a prior use. Systems which utilize the liquid to be transferred (petroleum or other hydrocarbons) to give the pipe the required weight in a "float/sink" deployment, run the risk of a spill of that liquid during deployment, and the associated environmental hazards and clean up.

The prior art does not include a rapidly deployable and retrievable system for transferring liquid from an offshore vessel to an onshore storage facility that does not require anchoring of the retrievable piping system on the sea floor. The prior art also does not disclose a rapidly deployable and retrievable system for transferring liquids from an offshore vessel to an onshore storage facility that avoids the environmental hazards associated with systems that depend upon the weight of a liquid in the pipe during the deployment process.

SUMMARY OF THE INVENTION

The Offshore Petroleum Discharge System (OPDS) of the present invention provides a system that can be rapidly deployed and retrieved. The system utilizes a flexible pipe which is significantly heavier than the seawater which it displaces, even when empty. Such a piping system can be deployed when empty, sink to the sea floor, and remain in place even under adverse currents and tides. The flexible pipe is of small enough outside diameter, generally less than nine inches, such that it presents a low profile to currents. It is also flexible enough to have a bending radius of generally no greater than five feet. This facilitates the storage of the pipe on large spools onboard a vessel. The flexible pipe is strong enough to resist the strain of being pulled ashore by an onshore winch, and of being retrieved by a winch aboard the vessel containing the storage spools.

The primary vessel of the OPDS system is large enough to carry up to eight miles of flexible pipe. The flexible pipe is carried on large spools, each capable of carrying up to two miles of pipe. An extra spool facilitates deployment and retrieval of the pipe, as well as repair of any damaged segment. The vessel is dynamic positioning capable, such that it can hold position under adverse weather conditions, currents, and tides, while unloading a tanker and transferring liquid to the pipeline termination unit onshore. The vessel contains a holding tank for the liquid, and two pumps, each capable of pumping as much as 1,500 gallons per minute, delivering pressures of 5,000 psi.

The vessel also contains the equipment needed to establish a presence on the beach adjacent to a storage facility. This includes one or more amphibious vessels and the means to launch and retrieve those vessels; multi purpose tractor for use on the beach; a winch to pull the flexible pipe ashore; and a pipeline termination unit to receive and connect to the flexible pipe and to transfer the received liquid to the onshore storage facility. The vessel also contains the equipment needed to receive liquid from a tanker. This would include a holding tank for receiving the liquid and floating hose for connecting the holding tank to the tanker.

In practice, the primary vessel would arrive offshore of the area onshore requiring the delivery of liquid. The vessel is equipped with side scan sonar, such that the best route for the flexible pipe to the beach can be determined. The primary vessel would approach the ten meter curve, and launch one of the amphibious vehicles, containing the pipeline termination unit, winch, multipurpose tractor, and required personnel. The amphibious vehicle would pull a small messenger line from the primary vessel to the landing site. Once ashore, the multipurpose tractor would be used to prepare a suitable location for the pipeline termination unit and the winch. The messenger line would be attached to the winch, and a towline brought ashore. The tow line would be attached to the end of the flexible pipe. The flexible pipe would then be winched ashore, the pipe sinking as it enters the water, since it is heavier than the water it displaces.

Once ashore, the flexible pipe is connected to the pipeline termination unit, which is in turn connected to a liquid storage facility. The primary vessel then moves offshore from the ten meter curve, deploying flexible pipe as it goes, until it reaches the point where a tanker will be offloaded. The primary vessel can hold up to eight miles of flexible pipe in two mile segments. Once to the offloading point, the primary vessel will connect a buoy to the end of the flexible pipe such that the end of the flexible pipe can be easily recovered when the tanker is in position to be offloaded.

A tow line is connected to the tanker, and the tanker and primary vessel are maneuvered into position. The floating buoy and flexible pipe is retrieved and connected to the outlet of the pumping system aboard the primary vessel. The outlet manifold of the tanker is connected to the holding tank of the primary vessel using floating hose. The primary vessel is held in place using its dynamic positioning capabilities.

Under certain conditions a tender vessel may be needed to assist with positioning the tanker, and with other tasks. Once the tanker is connected to the holding tank of the primary vessel, and the end of the flexible pipe is connected to the pump on board the primary vessel, the pump in the tanker is used to transfer liquid from the tanker to the holding tank of the primary vessel. When sufficient liquid is aboard, the pump on the primary vessel is started, pumping liquid from the holding tank, through the flexible pipe, to the pipeline termination unit, and on to the storage facility ashore.

Once the transfer of liquid from the tanker is complete, another tanker can be brought into position, until the transfer of liquid at that location is no longer required. At that point, the flexible pipe is disconnected from the pipeline termination unit, and the winch on the primary vessel employed to retrieve the flexible pipe, rewinding it onto the pipe spools. The floating hose is retrieved and wound onto spools on the primary vessel. The amphibious vehicle collects the pipeline termination unit, multipurpose tractor, and winch, and returns to the primary vessel. The primary vessel is then ready to proceed to the next location needing the transfer of liquid from a tanker to an onshore location.

DETAILED DESCRIPTION OF THE PREFERRED EMBODIMENT

The preferred embodiment of the present invention uses a primary vessel (10) and a tender vessel (70). The primary vessel (10) may be a 348'×70'×28' vessel, and the tender vessel (70) a 165' fast supply vessel. Both vessels can operate on JP-5 fuel, eliminating the need to provide diesel fuel.

Figure 1:
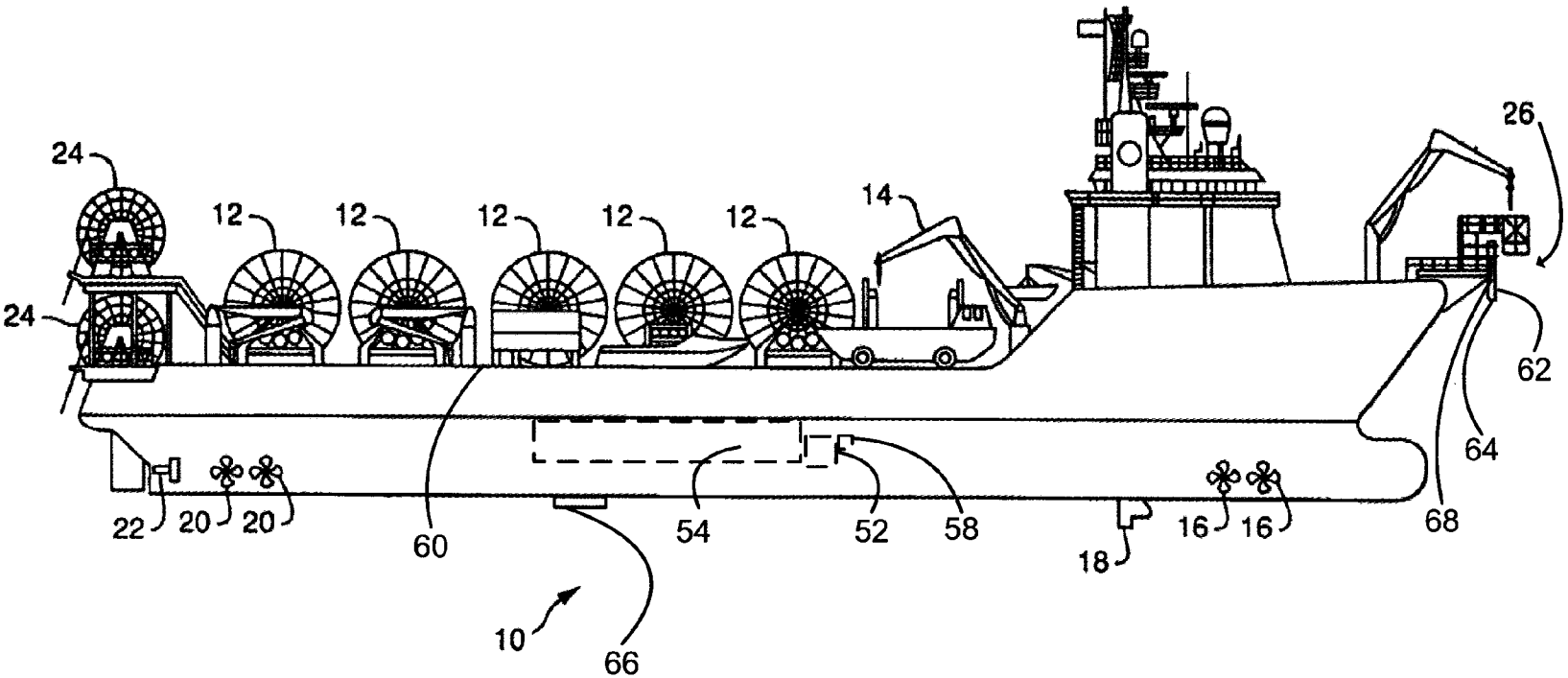
FIG. 1 of the drawings is the starboard side view of the primary vessel of the present invention.

Primary vessel (10) has proven speed powering capabilities, and improved motion characteristics. Primary vessel (10) is dynamic positioning capable, classed by the American Bureau of Shipping with a DP-2 notation. The primary vessel (10) is powered with over 18,000 horsepower providing a speed over sixteen knots, fully laden in moderate weather (sea state 4.) As shown in FIG. 1, the primary vessel (10) is equipped with two tunnel thrusters (16), and a swing-down 360° Azimuthing thruster (18) forward, and two tunnel thrusters (20) and two main propulsion controllable pitch wheels (22) aft. Primary vessel (10) is capable of providing more than twice the amount of thrust required to hold a 50,000 deadweight ton tanker (40) in a forty knot wind, six feet waves, and three knot surface currents, while transferring 1.7 million gallons of jet propellant-5 (JP-5), or other liquids, per twenty hour workday from eight statute miles offshore.

The primary vessel (10) is equipped with the following:

- Bow Loading System (26) with active swivel (62), quick disconnect (64), quick connect (64), and pig system (68) (including a pipe pig);
- Two pipeline termination units (50);
- Eight miles of flexible pipe (30), plus 1,000 feet armored section of flexible pipe, five deck (60) mounted storage reels or spools (12), stern chute and connecting table;
- Two thirty foot sections of flexible pipe (30) for repair purposes;
- Flotation for 6,000 feet of flexible pipe (30);
- Two 1,000 feet sections of 6" ID float hose (46);
- Two float hose storage reels (24);

In addition the primary vessel (10) may be equipped with some or all of the following:

- Two Lighter Amphibious Response Cargo 15 Ton vehicles (LARC XV) (42) each equipped with a 50,000 to 60,000 pound winch;
- Two launching and recovery davits (14) for LARC XV (42);
- Two multipurpose tractors;
- Towing winch;
- Large rigid inflatable workboat and launch and recover davit;
- Two 1,500 GPM 5,000 psi transfer pumps (52), each driven with independent diesel power;
- Small vessel fueling station;
- Watermaker: capacity 30 tons per day and storage;
- Internal holding/transfer cargo tank (54);
- Flexible pipe anchors;
- Side scan sonar (66);
- Repair/workshop Tender vessel (70) is a 165' vessel capable of speeds in excess of twenty knots, a vessel that is able to work in shallow-draft areas assisting the primary vessel (10) in the deployment and retrieval of the flexible pipe (30), handling flotation and anchoring systems if required, as well as providing a stable platform for divers and storage for their gear, a vessel that may assist in the deployment of the float hose (46) to the tanker (40), as well as act as a tail tug for the tanker (40) when required. The tender vessel (70) will also be used for relieving beach crews, manning the Pipeline Termination Unit (PTU) (50) with a high-speed transit from the primary vessel (10) to shallow water, where its onboard rigid inflatable vessel will be used for exchanging personnel.

Tender vessel (70) will also be used to manage the flexible pipe (30) when installed, providing inspection services, repair services, and traffic control if required. Tender vessel (70) is equipped with 6,000 horsepower and a dropdown 360° Azimuthing bow thruster. The combination of primary vessel (10) and tender vessel (70) makes up a single eight mile system.

Primary vessel (10) and tender vessel (70) are maintained at a state-of-readiness with a full crew compliment on board and are capable of deployment to worldwide locations within twenty-four hours of notification. Once underway, vessels will maintain an average speed of sixteen knots in moderate weather (sea state 4) fully laden. Tender vessel (70) has a limited fuel range and may require refueling from primary vessel (10). In a full 10,000 mile voyage, considering refueling requirements, vessels will still maintain an average total trip speed of over thirteen knots.

Figure 3:
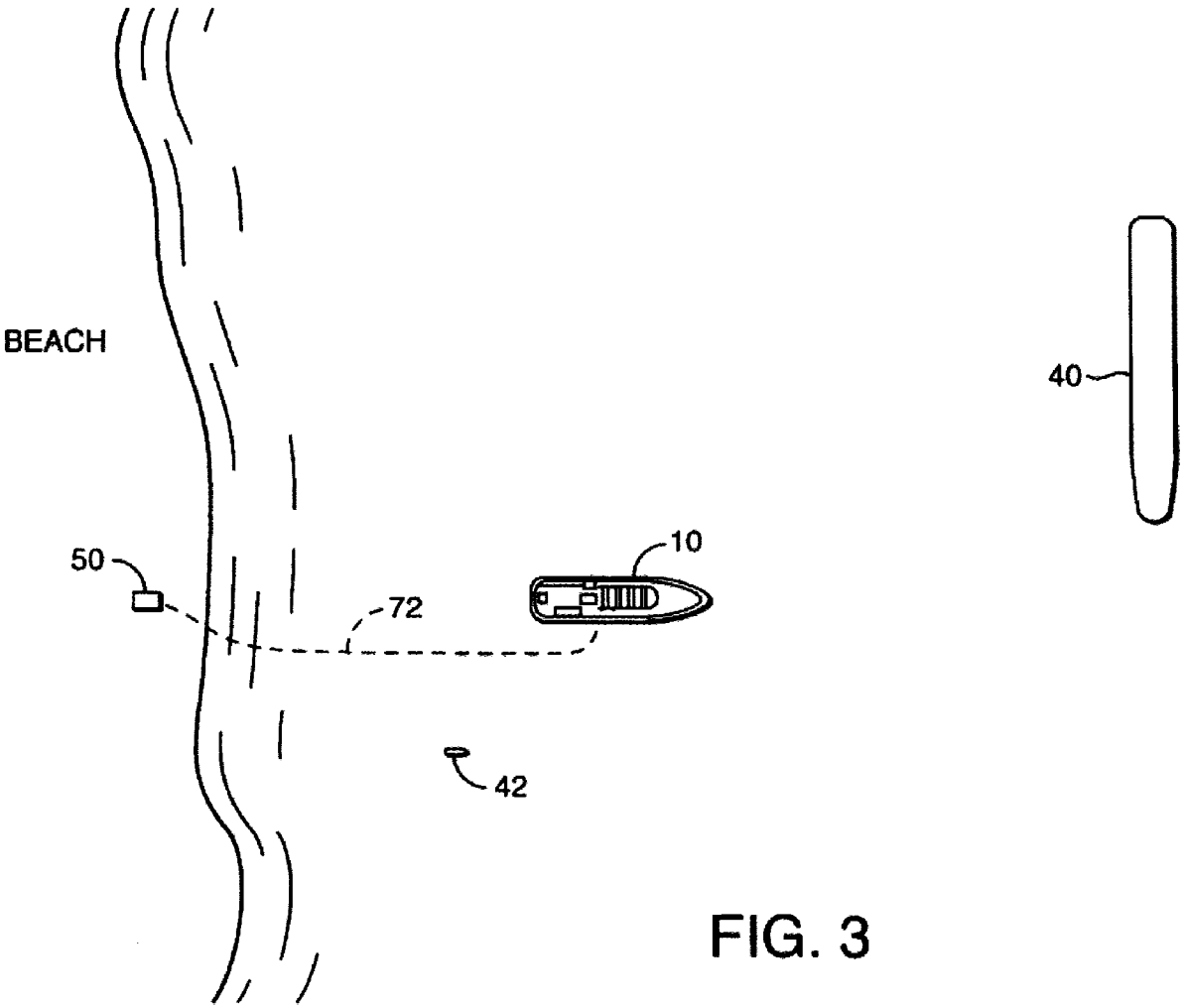
FIG. 3 of the drawings is a depiction of step one of the method of the present invention.

Upon arrival at the site where liquids need to be transferred from a tanker (40) to an onshore storage facility, primary vessel (10) will establish communications and identify the beach landing point. If required, primary vessel (10) will run a side scan sonar track into the beach landing point to the ten meter curve verifying that the bottom is free from debris or hazards and select the best deployment path for the installation of the flexible pipe (30). As shown in FIG. 3, during this procedure, the primary vessel (10) will launch an amphibious vehicle (42) carrying the multipurpose tractor and the pipeline termination unit (50). The amphibious vehicle (42) will receive a small messenger line (72) then proceed to the beach establishing the high-water mark where the PTU (50) will be offloaded and installed. The multipurpose tractor will construct the required berm around the PTU (50). The amphibious vehicle (42) will establish a position inland of the PTU (50), anchor itself with a beach anchor system, and commence recovery of the messenger line (72) using its onboard hydraulic winch. The messenger line (72) will bring ashore a soft towline, which will be attached to the end of the flexible pipe (30). Primary vessel (10) will then commence deployment of the flexible pipe (30) while maintaining station in dynamic positioning (DP) mode on the ten meter curve. At this point, dependant on the shore gradient and distance, primary vessel (10) can call upon tender vessel (70) to assist in pulling flexible pipe (30) into shallower waters. The flexible pipe (30) will be winched ashore. The flexible pipe (30) is designed to be deployed "sink/sink" unless the beach approach has heavy rocks or heavy coral, then there is the option to provide detachable floatation collars to deploy in a float/sink mode. The flexible pipe (30) has been designed with a double extruded external sheathing to increase its durability and has been designed to withstand a straight-line pulling of up to 351,762 pounds.

The flexible pipe (30) has an outside diameter as small as possible to limit its resistance to currents, and will generally be less than 9 inches, with a preferred embodiment having an outside diameter of 8.11 inches. The resistance of the flexible pipe (30) in sand or mud is relatively small. The flexible pipe (30) is heavier than the water it displaces, even when empty. A preferred embodiment of the flexible pipe (30) weighs 36.30 pounds per foot, and provides negative buoyancy in seawater of 13.62 pounds per foot empty. The flexible pipe (30) has been designed to eliminate the need to anchor the line during or after deployment. The flexible pipe (30) has been designed to provide for an easy, efficient installation, even with a three knot surface current and forty knot wind in six foot seas. The flexible pipe (30) has been designed to be installed empty and dry and will self bury. Installation of the flexible pipe (30) empty eliminates the creation of waste water after deployment.

Figure 4:
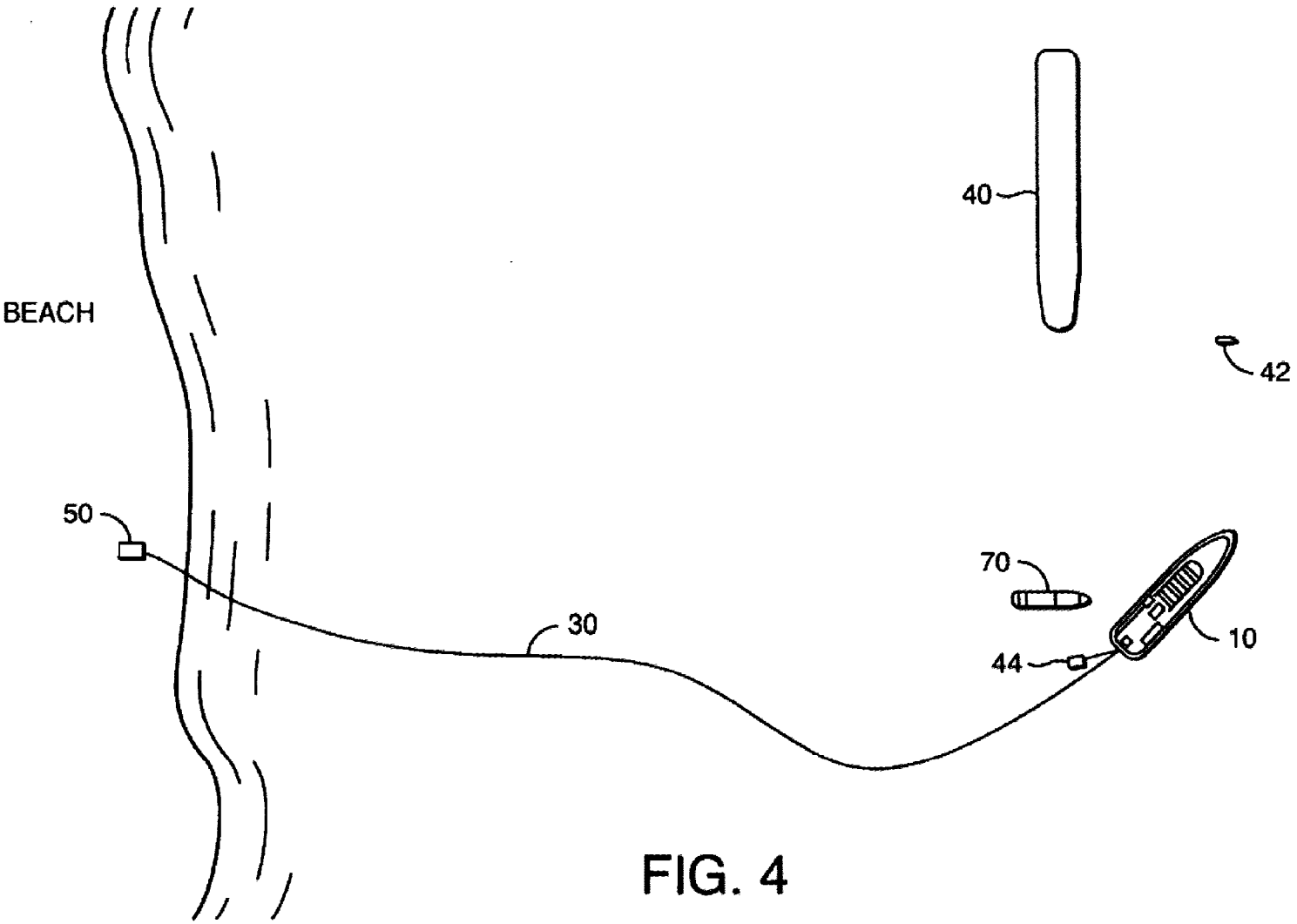
FIG. 4 of the drawings is a depiction of step two of the method of the present invention.
Figure 5:
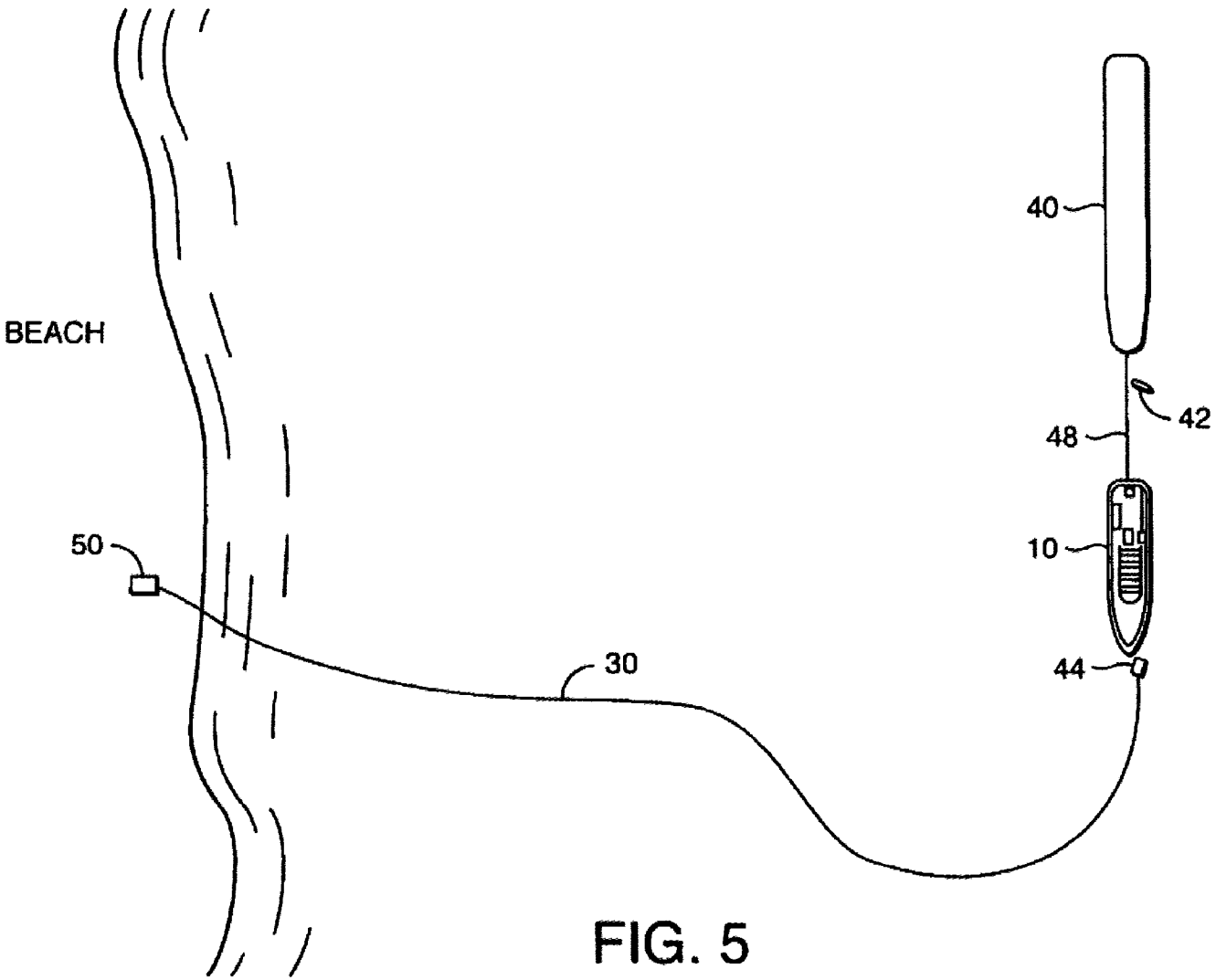
FIG. 5 of the drawings is a depiction of step three of the method of the present invention.
Figure 6:
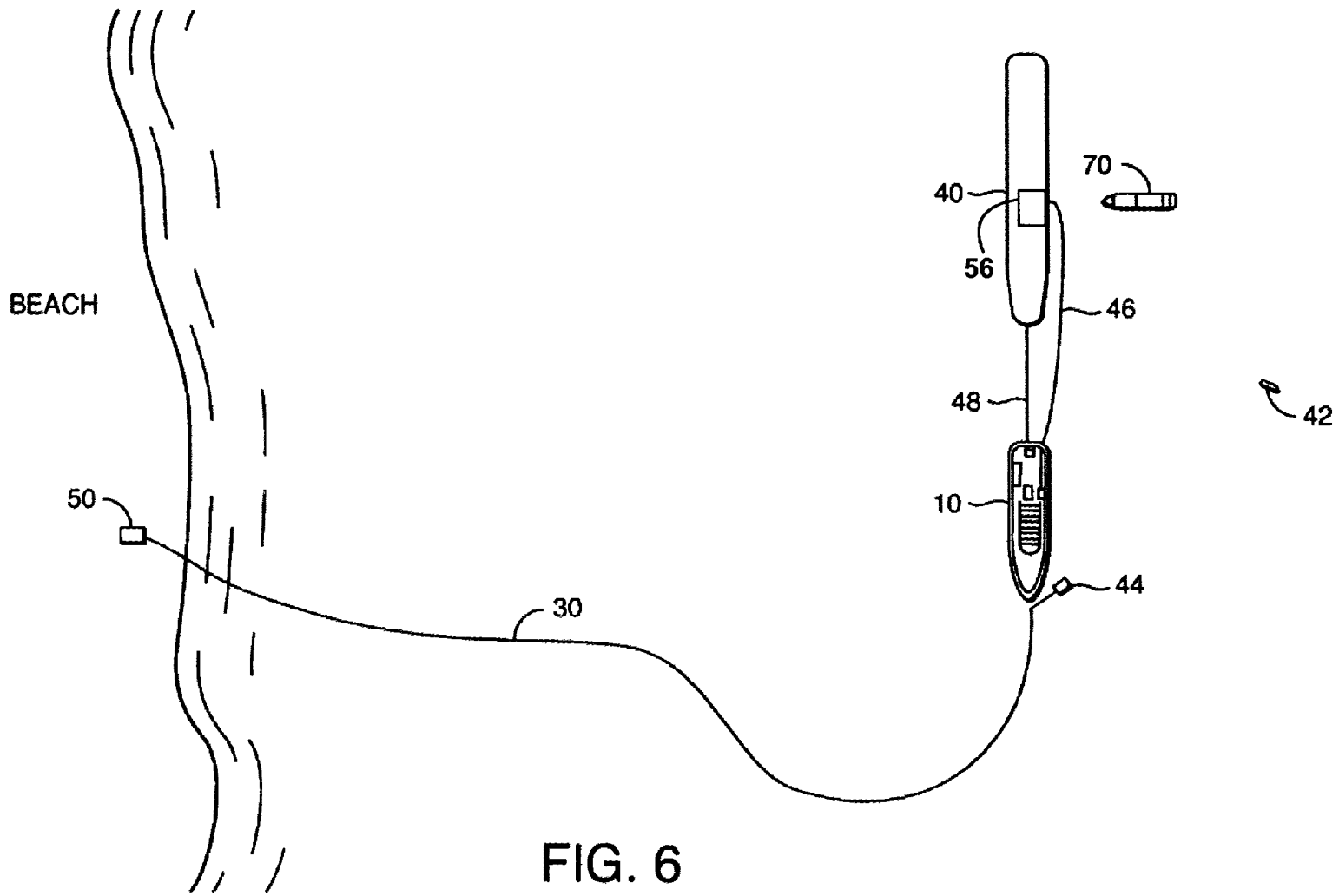
FIG. 6 of the drawings is a depiction of step four of the method of the present invention.
Figure 7:
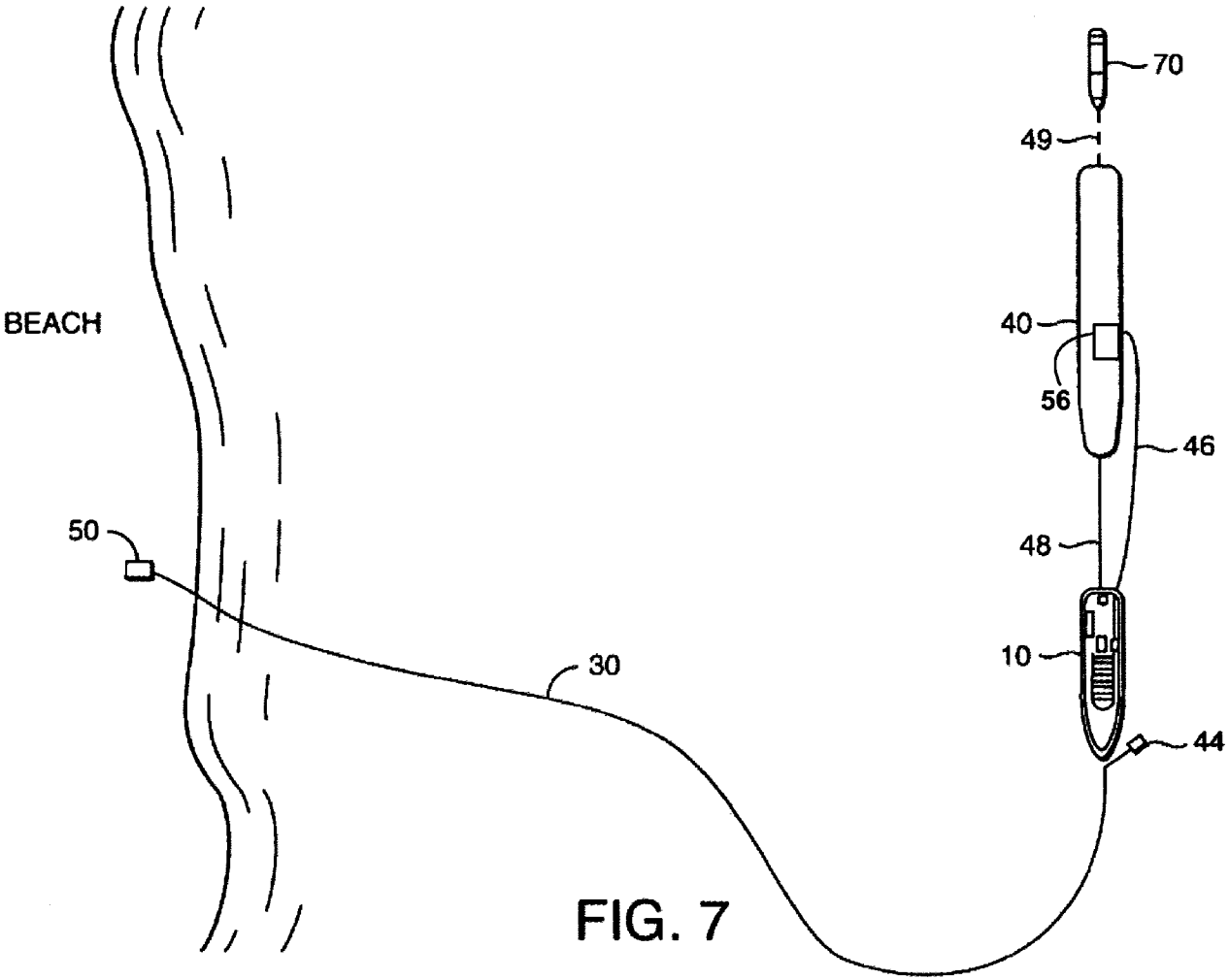
FIG. 7 of the drawings is a depiction of step five of the method of the present invention.

Once the flexible pipe (30) has been winched to the PTU (50) unit, connection will be made. As depicted in FIGS. 4 and 5, primary vessel (10) will get underway and continue deploying the flexible pipe (30) to the ocean floor at a rate of deployment of 0.3 miles per hour, until the primary vessel (10) reaches the offloading point. Flexible pipe (30) is made up of two mile segments. If the full eight miles is not required, shorter horizontal distances can be achieved by using fewer segments. For example, if only five miles is required, then six miles of flexible pipe (30) will be deployed and at the five mile offloading point, the flexible pipe (30) will be laid in a loop. Primary vessel (10) will attach a surface buoy (44) and a messenger line to the end of the flexible pipe (30) and drop it to the ocean floor. Primary vessel (10) then proceeds to rendezvous with the tanker (40), passes a messenger line and a hawser (48) to the bow of the tanker (40), and proceeds with the tanker (40) to the offloading point. Tender vessel (70) attaches a stem line (49) to the tanker (40), as shown in FIG. 7, to assist primary vessel (10). Primary vessel (10) will recover the soft buoy (44) with a grappling hook or if required utilize its rigid inflatable workboat or tender vessel (70) to assist in the recovery of the soft buoy (44). Once the soft buoy (44) has been retrieved, the messenger line will be fed to the bow loading system (26), and recover the end of the flexible pipe (30) into the bow loading system (26). It will be automatically connected with the quick connect system to the cargo discharge piping. Flexible pipe (30) will undergo a pigging operation originating from the primary vessel (10). The pig will be recovered at the PTU (50). The flexible pipe (30) has been deployed empty and dry. Whether the method of deployment was sink/sink or float/sink (using floatation collars on the flexible pipe (30)), the deployment generates no waste water, and the pigging operation is used as a safety integrity check.

Simultaneous to this operation, primary vessel (10) deploys a float hose (46) from its stern to mid-ship area of the tanker (40) assisted by either the tender vessel (70) or a rigid inflatable workboat. Tanker (40) will connect float hose (46) to its discharge manifold and under orders from the captain of the primary vessel (10), tanker (40) will commence offloading. Liquid cargo will be offloaded into a holding/transfer tank (54) on primary vessel (10) and then transferred via high-pressure transfer pumps (52) through the flexible pipe (30) to the PTU (50) at a rate of 1.7 million gallons per twenty hour period with an output pressure at the PTU (50) between 50 and 125 psig. The entire deployment operation can be completed in less than forty-eight hours.

Primary vessel (10) will maintain its position over the offloading point utilizing its dynamic positioning (DP) capability. Where phenomenon known as surging and fishtailing occurs, which sometimes results from two different size, different draft hulls being tied in close proximity, the tender vessel (70) will be attached to the stern of the tanker (40), if required, maintaining the tanker in a weathervane position behind primary vessel (10).

When offloading is complete, primary vessel (10) will release flexible pipe (30) to the ocean floor with soft buoy (44) attached. Float hoses (46) from the tanker (40) will be recovered. Tanker hawser (48) will be released. Tender vessel (70) will be released. Primary vessel (10) will rendezvous with next offloading tanker (40) and repeat procedure.

Once operations have been completed and it is desired to retrieve the system, primary vessel (10) will pig the flexible pipe (30) insuring that it is once again empty, disconnect the flexible pipe (30) from the PTU (50) and its discharge line, pass the messenger line across the stern of the primary vessel (10), and will commence retrieving the flexible pipe (30) onto its powered storage reels or spools (12).

Simultaneously, the PTU (50) will be disconnected and loaded on board the amphibious vehicle (42). The multipurpose tractor will be loaded on board the amphibious vehicle (42). The amphibious vehicle (42) and personnel will be returned and loaded on board the primary vessel (10).

When flexible pipe (30) retrieval is completed, primary vessel (10) and tender vessel (70) will get underway to the next destination. The total retrieval process will be completed in less than seventy-two hours and can be accomplished in an environment of forty knot winds, six foot waves, and three knot surface currents. The OPDS system, primary vessel (10), and tender vessel (70) will survive in fifty-five knot winds, twelve foot waves, and five knot surface currents over a seventy-two hour period.

The Offshore Petroleum Discharge System (OPDS) combines various components to achieve liquid delivery in a quick, safe, environmentally responsible manner. One of the key components is flexible pipe (30). The flexible pipe (30) provides a viable deployment method that comprises environmentally sound loading and landing of the flexible pipe (30) ashore. The flexible pipe (30) is deployed "sink/sink," which allows for installation in up to three knot currents, forty knot winds, and six foot waves; survival in up to five knot currents, fifty five knot winds, and twelve foot waves; provides for deployment up to eight statute miles offshore; and provides for installation in forty-eight hours and retrieval in seventy-two hours.

The flexible pipe (30) with a preferred embodiment having outside diameter of 8.11 inches is a cost effective alternative to complicated and diver installed anchoring systems. This outside diameter minimizes the current loads imposed on the flexible pipe (30) keeping it stable in all but the most severe current and surf conditions. Anchoring systems may still be provided on an as required basis.

The flexible pipe (30), such as that manufactured by Technip, has been used in the offshore exploration and production industry. It is designed in accordance with API17J "Specification for Unbonded Flexible Pipe." The flexible pipe (30) is negatively buoyant to ensure pipeline seafloor stability in extremely high cross currents, three knot installation, and five knot survival. Unlike a float/sink pipeline, which must float into place empty and be sunk by filling with either product or seawater, a sink/sink pipeline is heavy enough on the bottom (empty) to survive the specified currents without the need for excessive anchoring. Limited or no anchoring will require only minimal or no diver support.

An added benefit of the sink/sink deployment scheme is that no ballast is required for the flexible pipe (30) deployment. The flexible pipe (30) sinks under its own weight. The flexible pipe (30) endfittings can fully seal the end of the flexible pipe (30), allowing for external leak testing prior to the flexible pipe (30) being sunk to the seafloor. This mitigates against spills in accordance with best environmental practices used in the offshore field today. The flexible pipe (30), once installed, will have been leak tested and is empty, contributing minimal wastewater requiring handling and disposal. If completely flooded, the entire eight statute mile flexible pipe (30), with an inside diameter of 5.7 inches, will contain approximately 50,000 gallons. With minimal connections being made and tested by trained personnel in accordance with best marine practice, the system is installed without the risk of a spill.

The flexible pipe (30) can be repaired on board the primary vessel (10). The primary vessel (10) is equipped with repair endfittings, installable within twenty-four hours. The repair endfitting is capable of sustaining all internal pressure and tensile loadings as the original endfitting. The size of the repair endfitting, and the need to service the endfittings on the storage reels (12), is such that the repaired section will be removed to and stored on the additional reel (12). If a section of the flexible pipe (30) needs to be moved about the primary vessel (10) for servicing or inspection, it can be moved to and from the primary vessel's vertical powered storage reel (12). This allows the system to be completely self sufficient and not dependent on significant shore based resources.

The management of static electricity is a concern in the flexible pipe (30). Non-conductive surfaces affect the rates of charge generation and charge dissipation during flow through a pipe. The rate of charge generation is similar in conductive and non-conductive pipes, while the rate of charge lost can be significantly slower in non-conductive pipes. For charged non-conductive liquids (such as JP-5) insulation by the pipe wall can result in charge accumulation of the opposite polarity on the outer surface of the insulating liner or pipe. Charge accumulation can eventually lead to electrical breakdown and pinhole punctures of either the liner or, in the case of non-conductive pipe, the entire wall thickness.

Figure 2:
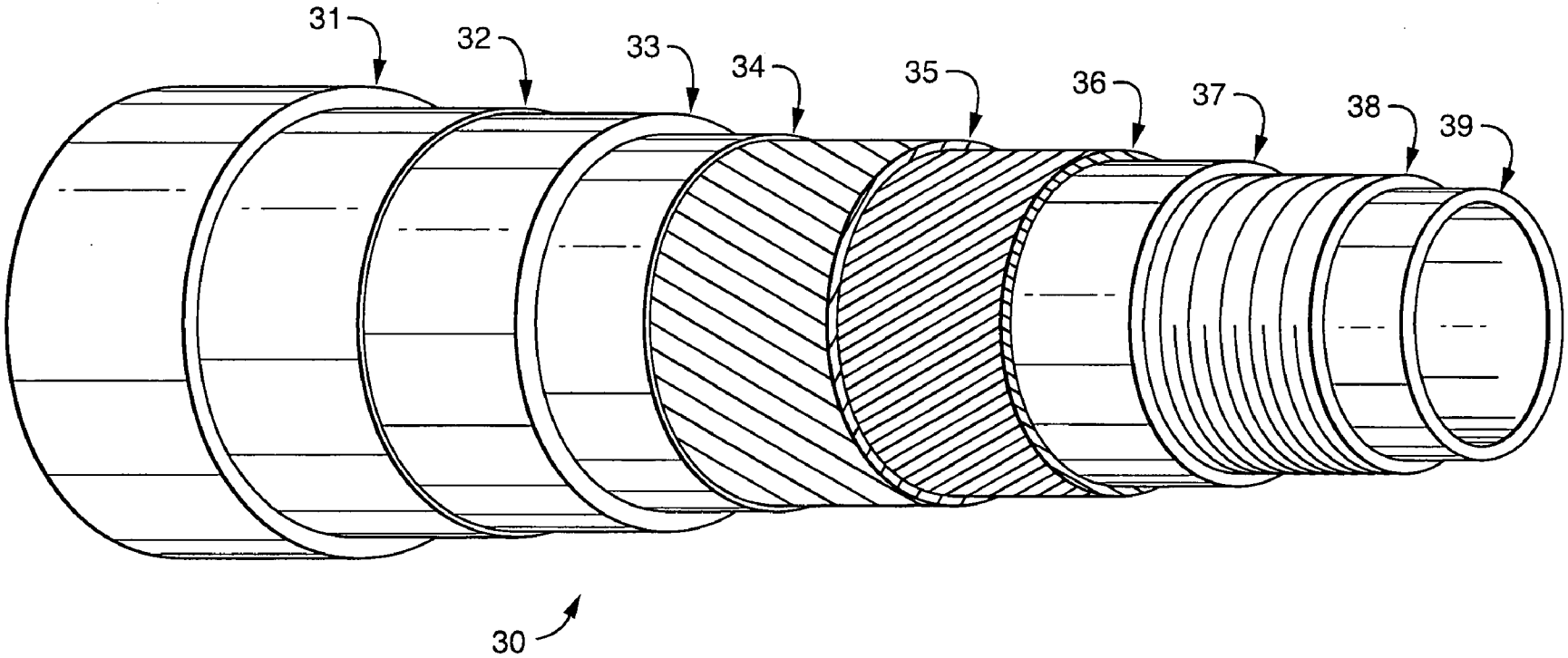
FIG. 2 of the drawings is a cutaway illustration showing the layers of the flexible pipe of the present invention.

The flexible pipe (30) is comprised of nine layers as shown in FIG. 2. The outer layer is a TPE protective sheath (31). The next layer is KEVLAR fabric tape (32); the next layer a polyethylene sheath (33); inside of the polyethelene sheath (33) is another layer of KEVLAR fabric tape (34); followed by an outside armor layer (35), and an inside armor layer (36); a layer of "zeta wire" (37) (as made by Technip); followed by a layer of Rilsan pressure sheath (38); with a final interlocked stainless steel carcass (39) inside layer.

The accumulation of static electricity eventually could cause damage to the Rilsan pressure sheath (38). However, the stainless steel interlocked carcass (39) is conductive and will be electronically connected to the flexible pipe (30) endfitting, which is made of carbon steel and is grounded by contact with sea water. The charge separation still occurs between the fluid and the carcass (39). But since the carcass (39) is electrically connected to the grounded endfittings, the electrical charge will evacuate into the sea and accumulation is impossible.

The interlocked carcass (39) is not leak proof and some fluid, such as JP-5, will be in contact with the non-conductive Rilsan pressure sheath (38); however, no charge is anticipated to accumulate into the pressure sheath (38) since the fluid in contact with the pressure sheath (38) will be stagnant, the stainless carcass (39) will be grounded and will act as a grillage eliminating the charge of any fluid passing through it, and the inner surface of the Rilsan pressure sheath (38) will be in contact with the stainless steel carcass (39) and any charge created in the pressure sheath (38) will be evacuated by the stainless steel carcass (39). Accordingly, the stainless steel carcass (39) will protect the Rilsan pressure sheath (38) from having accumulation of electrical charges.

This flexible pipe (30) can be installed within forty-eight hours of the vessel arrival on location, and is very robust. The flexible pipe (30) can be installed on various soils such as sand, mud, rocks, or coral. Accordingly, there will be only a few hours allocated for survey of the seabed. The flexible pipe (30) has, in addition to the standard polyethylene external sheath (33), a reinforced protective sheath made of thermoplastic elastomer (TPE) (31). Both sheaths will be separated by a layers of KEVLAR tape (32 and 34). The TPE protective sheath (31) has a superior resistance to abrasion and the KEVLAR tape layer (32) will mechanically reinforce the external sheath and protect it, should any local hazard damage it.

The flexible pipe (30) will be suitable for twenty plus years of service life. The flexible pipe (30) length may vary from any length up to eight miles. Also, should the flexible pipe (30) be damaged locally, the system shall be versatile enough to continue the operation while repairing the line. It is therefore more adequate to have a flexible pipe (30) with a limited number of sections that are connected together during the deployment operation. Should a section be damaged locally, another section will be laid while the damaged section is repaired using the deck mounted vertical powered storage reel (12).

During recovery, a visual inspection of the line is sufficient to detect any defect in the outer sheath (31). In addition, the water tightness of the external sheath (31) can be checked by vacuum tests while the flexible pipe (30) is packed on the reels (12). Should any defect be detected, repair procedures can be performed. In case of local damage, the flexible pipe (30) can be easily repaired. If the external sheath (31) is damaged, a new plastic patch can be "welded" to the plastic. This plastic patch is waterproof. If further layers of the flexible pipe (30) are damaged, the line can be cut and two new end fittings can be mounted on the extremities. Both repair procedures can be done offshore and the provision of the deck mounted storage reel (12) will allow completion of the repair with the minimum disturbance to operations.

Flexible pipe (30) specifications for a preferred embodiment are:

| Characteristics | | Imperial | | Metric | |
|---|---|---|---|---|---|
| Diameter: | Inside | 5.70 | in | 144.80 | mm |
| | Outside | 8.11 | in | 206.10 | mm |
| Weight: | In air empty | 36.30 | lbf/ft | 54.46 | kgf/m |
| | In sea water empty | 13.62 | lbf/ft | 20.27 | kgf/m |
| Pressure: | Nominal bursting | 10587 | psi | 730 | bars |
| | Hydrostatic collapse | 1406 | psi | 97 | bars |
| Damaging Pull: | In straight line | 351762 | lbf | 1564.72 | kN |
| Minimum Bending Radius | For storage | 4.40 | ft | 1.34 | m |

Tanker (40) will be offloaded utilizing tanker's discharge pumping system (56) typically providing 100 psi at the tanker (40) rail. Liquid cargo will be moved via 6" ID floating hose (46) into the primary vessel (10) holding/transfer tanks (54). The holding/transfer tank (54) will utilize automated valving integrated into a digital control system comprised of high level and low level liquid level alarms. Levels will be monitored both locally, the tank location and the primary vessel's (10) bridge/control center with automated valve control and electrostatic discharge (ESD) capabilities at each location.

Constant transfer tank liquid level will be maintained by a pneumatically actuated control valve located on the inlet side of the transfer tank. A small primer pump will move cargo from the holding/transfer tank to the main transfer pump, which is a dual casing "barrel" pump, multi-stage, centrifugal. All centrifugal pumps are designed to be operated in a certain range of their performance curve. Operation beyond a certain maximum flowrate, or below a certain minimum flowrate is detrimental to the pump and will reduce its life. Initial startup may be with an empty discharge line, such that the pump will try to produce flows in excess of the recommended maximum until the line fills and back pressure reduce the flowrate. Alternately, if the discharge pressure becomes excessive for any reason (blockage in the line, closed discharge valve, etc.), damage can occur from the flowrate being below the minimum recommended flowrate. For these reasons, a discharge control valve (58) is utilized.

On initial startup (pipeline empty) when energized, the valve (58) will sense low system pressure in the pipeline and partially close the valve to maintain operation of the pump in its acceptable operation range relative to its performance curve. The approximate minimum discharge pressure for satisfactory operation of the pump is 4500 psig. The valve will hold the design pressure at the design condition of 5000 psig (1500 GPM) and hold there until pressure equalizes. At the point where the pipeline pressure equals the pump design pressure, the valve will remain in that setting position until its senses change in the pipeline pressure. If the pipeline pressure goes down during operation due to reduced friction losses (the primary vessel (10) moves closer to shore for example), the valve will again begin to close to impose the artificial design pressure of 5000 psig. In the case where the pipeline pressure increases for any reason above the design pressure (blockage in the line or increased friction losses due to increased distance from shore), the valve will open to allow more flow and reduced pressure until it reaches "full open" position.

A by-pass control valve will also be installed. If the discharge pressure continues to rise higher than the acceptable minimum flow for the pump (maximum pressure), then the by-pass valve will sense this pressure and begin to open allowing flow to go back to the holding tanks relieving the pressure on the pump and allowing it to operate in its acceptable operating range. As the discharge pressure reduces, the by-pass valve will begin to close until pump reaches its acceptable operating range and the discharge control valve will again take over control of the system.

Primary vessel (10) is equipped with two complete transfer pumps, each with its own independent diesel engine. One will act as primary, one will be backup. Each pump will be capable of transferring cargo at a rate of 1.7 million gallons per twenty hour day from a distance of up to eight miles.

Primary vessel (10) will be equipped with two amphibious vehicles (42), such as a LARC XV, to support the beach terminus requirement. The LARC XV is an excellent amphibian to work an environment of forty knot winds, six foot waves, and three knot surface current both in the water and ashore. The LARC XV amphibian's winch and other logistics are readily available in the U.S. market.

The LARC XV amphibian characteristics are:

| LARC XV | |
|---|---|
| Weight (dry): | 45,000 lbs |
| Weight (fully loaded): | 75,000 lbs |
| Cargo bay: | 23'11" × 11'11/25" |
| Overall length: | 45' |
| Overall width: | 14'8" |
| Overall height: | 15'4" |
| Ramp width: | 9' |
| Ramp capacity: | 9,000 lbs |
| Hull material: | Aluminum |
| Cargo Space: | 45' × 15' |
| Weight capacity: | 15 tons |
| Power: | Two (2) 300 HP Cummins Diesel |

To provide the necessary beach OPDS interface to the receiving services, the LARC XV amphibious vehicle (42) is embarked on primary vessel (10). The amphibious vehicle (42) will deploy from the primary vessel (10) to the designated PTU (50) site. The amphibious vehicle (42) has a robust power ramp to allow the deployment of the multipurpose tractor and PTU (50), with PTU (50) hook up hardware and beach anchoring system The multipurpose tractor has a capacity to provide multipurpose front digging blade, forklift tines, backhoe, and other capacity features. The tractor will be embarked within the amphibious vehicle (42) and deployed from the amphibious vehicle (42) upon landing on the designated beach. The multipurpose tractor will move the PTU (50), the PTU (50) hookup equipment and anchoring systems. These items will be positioned for deployment using the multipurpose tractor.

What I claim is:

1. A system for transferring liquid, comprising:

a flexible pipe, that is negatively buoyant in sea water in an empty state, configured to be deployed and retrieved from a vessel comprising a hull;

one or more powered spools adapted to lay the flexible pipe onto a sea floor without anchoring the pipe to the sea floor and to retrieve the unanchored pipe from the sea floor by winding the pipe back onto the powered spools, the spools being located on the vessel;

a pump, located in the vessel, for pumping the liquid through the flexible pipe, to a location onshore, wherein the pump has a sufficient capacity to pump 1.7 million gallons of liquid from the vessel through 8 miles of the flexible pipe to the location onshore in 20 hours;

a bow loading system comprising a connector for the flexible pipe and a swivel mechanism; and a dynamic positioning system configured to maintain a position of the vessel over an offloading point during transfer of the liquid to shore, wherein the vessel is unmoored and the dynamic positioning system allows the vessel to rotate around the offloading point.

2. The system of claim 1, further comprising:

a holding tank in the vessel, wherein the holding tank comprises an inlet, for receiving the liquid from a source, and the pump draws the liquid from the holding tank and pumps the liquid through the flexible pipe to the location onshore.

3. The system of claim 2, wherein the source comprises a tanker vessel holding the liquid and the liquid is pumped by the tanker vessel through a hose to the holding tank in the vessel.

4. The system of claim 2, further comprising a control valve for regulating a back pressure on the pump for pumping the liquid being transferred from the holding tank through the flexible pipe.

5. The system of claim 1, wherein the flexible pipe has an outside diameter small enough to resist being moved by water currents.

6. The system of claim 1, wherein the flexible pipe has an outside diameter of less than nine inches.

7. The system of claim 6, wherein the flexible pipe is capable of bending to a radius of five feet.

8. A system for transferring liquids, comprising:

a vessel comprising a hull and a deck;

a flexible pipe, that is heavier than the water which the flexible pipe displaces when empty, for conveying a liquid from the vessel to an onshore facility;

a bow loading system comprising a connector for the flexible pipe and a swivel mechanism;

a hose, for receiving from a tanker, the liquid to be transferred to the onshore facility;

a pump, located in the vessel for pumping the liquid being transferred through the flexible pipe, wherein the pump has sufficient capacity to pump 1.7 million gallons of liquid from the vessel through 8 miles of flexible pipe to the onshore facility in 20 hours; and a dynamic positioning system configured to maintain position of the vessel over an offloading point during transfer of the liquid.

9. The system of claim 8, wherein the flexible pipe has an outside diameter of less than nine inches.

10. The system of claim 8, wherein the flexible pipe is capable of bending to a radius of five feet.

11. The system of claim 8, further comprising:

one or more spools located on the deck for deploying the flexible pipe onto a sea floor without anchoring the pipe to the sea floor and for retrieving the unanchored flexible pipe from the sea floor by winding the flexible pipe back onto the spools.

12. The system of claim 8, the vessel further comprising:

a side scan sonar for evaluating the condition of the sea floor upon which the flexible pipe is to be deployed.

13. The system of claim 8, further comprising:

a clearing and testing system for the flexible pipe comprising a pipe pig.

14. The system of claim 8, wherein at least a portion of the flexible pipe is armored to prevent damage when deployed.

15. The system of claim 8, wherein the flexible pipe comprises a steel layer which is grounded to discharge any buildup of static electricity during liquid transfer.

16. The system of claim 8, further comprising:

a holding tank configured to receive the liquid from a tanker through the hose and to serve as a source in the vessel of the liquid for pumping through the flexible pipe.

17. A petroleum discharge system comprising:

a vessel having a hull;

a plurality of powered spools on the vessel;

a plurality of sections of flexible pipe, wherein the flexible pipe is negatively buoyant in seawater in an empty state, and wherein the powered spools are adapted to lay the flexible pipe onto a sea floor without anchoring the flexible pipe to the sea floor during or after deployment of the flexible pipe, and the powered spools are adapted to retrieve the unanchored flexible pipe from the sea floor by winding the flexible pipe back onto the powered spools;

a holding tank having an inlet for receiving petroleum from a tanker;

a pump housed in the vessel, wherein the pump has sufficient capacity to pump 1.7 million gallons of petroleum from the holding tank through 8 miles of the flexible pipe to shore in 20 hours, and the petroleum discharge system is designed to simultaneously receive petroleum from the tanker into the holding tank while pumping the petroleum through the flexible pipe to shore;

a bow loading system comprising a swivel mechanism, wherein the bow loading system is located at a bow of the vessel, and the bow loading system is adapted to be connected to the flexible pipe; and a dynamic positioning system (DPS), wherein the DPS is adapted to maintain the vessel over an offloading point corresponding to a location of the flexible pipe while the tanker is connected to the vessel and while the pump pumps petroleum through the flexible pipe to shore, and the DPS allows the vessel and connected tanker to rotate about the offloading point.

18. The petroleum discharge system of claim 17, wherein the petroleum discharge system further comprises;

a tender vessel that is adapted to be connected to a stern of the tanker with a line to assist in maintaining a position of the tanker while the tanker is pumping petroleum into the holding tank of the vessel; and an amphibious vehicle carrying a tractor, a beach termination unit, and a winch, wherein the vessel is adapted to carry the amphibious vehicle which carries the tractor, the beach termination unit and the winch, and the vessel is adapted to deploy the amphibious vehicle into the sea, thus allowing the amphibious vehicle to transport the tractor, the beach termination unit, and the winch to shore.

* * * * *